US005494161A

United States Patent [19]

Herbst

[11] Patent Number: 5,494,161

[45] Date of Patent: Feb. 27, 1996

[54] HANGING FOLDER FILE BOX

[75] Inventor: John E. Herbst, Bolingbrook, Ill.

[73] Assignee: Fellowes Manufacturing Company, Itasca, Ill.

[21] Appl. No.: 272,094

[22] Filed: Jul. 8, 1994

[51] Int. Cl.[6] ..... B65D 5/44

[52] U.S. Cl. ..... 206/425; 312/184

[58] Field of Search ..... 206/448, 425; 312/184

[56] References Cited

U.S. PATENT DOCUMENTS

| | | | |
|---|---|---|---|
| 1,050,409 | 1/1913 | Wadsworth et al. | 312/184 |
| 3,456,994 | 7/1969 | Sullivan | 312/184 |
| 3,724,920 | 4/1973 | Beck | 206/425 |
| 4,266,715 | 5/1981 | Garrison | 206/425 |
| 4,505,388 | 3/1985 | Solomon | 206/425 |
| 4,726,635 | 2/1988 | Rariden et al. | 312/184 |

FOREIGN PATENT DOCUMENTS

| | | | |
|---|---|---|---|
| 528053 | 10/1940 | United Kingdom | 312/184 |

OTHER PUBLICATIONS

A product leaflet from Perma Products® for Letter–Legal Hanging File Box (Product #17020) and including Assembly Instructions, which is believed to have been available prior to the filing of the application. No date.

An undated sheet from an unknown catalog showing a Perma® Hanging File Box believed to have been available prior to the filing of the application. No date.

A 1993 Bankers Box® product borchure from Fellowes® that shows a Portable File, Stock #61114.

A 1988 Premier Line™ from Fellowes® that shows a Portable Filing System, Stock #51114.

*Primary Examiner*—Jimmy G. Foster
*Attorney, Agent, or Firm*—Willian Brinks Hofer Gilson & Lione

[57] ABSTRACT

A hanging folder file box is provided with four substantially equal sides and with two opposite side panels located within the box and having a vertical height less than the vertical height of the sides of the box. The side panels removably receive channels that in turn receive notched ends of hanging folders so that the hanging folders are maintained completely with the box, A lid or cover can be provided to completely cover the hanging folders and their contents. The body of the file holder box is unitary and constructed of a material suitable for folding such as corrugated fiberboard.

7 Claims, 5 Drawing Sheets

HANGING FOLDER FILE BOX

BACKGROUND OF THE INVENTION

This invention relates to a hanging folder file box constructed of fiberboard that is easy to assemble by the consumer.

An increasing number of people maintain an office at their home or are establishing small businesses. Because of this increase, there is an expanding need for inexpensive and portable office products. One such item is hanging folder file box. Hanging folders generally have a pair of rods, typically metal, that support a fiberboard material into which fries, loose papers and the like can be stored and organized. The rods have notched ends that are received on a rod within for example, a desk or cabinet drawer. Desks and cabinets, however, are bulky and can not be easily moved. Accordingly, there is a need for a lightweight portable file holder.

One such lightweight file holder is manufactured by Fellowes Mfg. Co. as well as Perma Products. The file holder is a fiberboard box appropriately sized such that the sides of the box receive the notched ends of the hanging folder. Although these boxes are desirable for many reasons, a disadvantage is that the notched ends of the file holders extend beyond the outer periphery of the box so that it is difficult to provide a close fitting lid to completely cover the contents as well as the notched ends of the hanging folder.

Another such file holder is also manufactured by Fellowes Mfg. Co. This file holder is a fiberboard box where the vertical height of two opposite sides of the box is less than the vertical height of the other two opposite sides of the box. An H-shaped channel is placed on each of the two shorter sides and receive the notched ends of the hanging folder. A disadvantage to this type of box is that it is not advisable to stack a number of like boxes on top of each other because the strength is not adequate.

The present invention solves these problems by providing a box wherein the vertical height of each of the sides of the box are substantially equal and by providing a pair of H-shaped channels on side panels having a vertical height less than the vertical height of the sides of the box. The channels receive the notched ends of the hanging folders within the inside of the box. In this way, the contents of the folders, as well as the notched ends of the folders can be completely covered by a lid. Furthermore, the boxes can be stacked in a stable manner.

SUMMARY OF THE INVENTION

The present invention comprises a hanging folder file box that comprises a unitary fiberboard body and a pair of channels parallel to two side walls of the box. The body when assembled, comprises a base, preferably including an inside bottom and an outside bottom, a first pair of spaced apart and parallel side walls, a second pair of spaced apart and parallel side walls normal to the first pair of side walls, and a pair of bottom side panels that are adjacent to either the first pair of side walls or the second pair of side walls. The flutes in the side panels are preferably oriented in a vertical direction to advantageously provide strength to the side panels. The side walls preferably have an equal vertical height and the panels preferably have a vertical height less than the vertical height of the side walls.

A pair of channels are removably attached to the side panels. The channels are preferably H-shaped so that each channel has a pair of upstanding flanges that will receive the notched ends on the rods of the hanging folder and a pair of downstanding flanges that will removably engage the side panels. More preferably, the upstanding flanges are spaced apart a distance greater than the downstanding flanges. The folders are thus maintained within the box and do not exceed the vertical height of the side walls of the box so that a lid or cover may be placed on the top of the side walls to completely cover the hanging folders and their contents and to permit several like boxes to be stacked in a stable manner.

In the most preferred embodiment, the box comprises a body of a single piece of corrugated fiberboard. Accordingly, in this embodiment the fiberboard is cut and provided with fold lines so that when the various portions forming the body are folded and glued, a complete box is formed. When the body is in an unfolded and unglued state, it includes an inside bottom, a first pair of side walls including a first and a second side wall, a second pair of side walls including a third and a fourth side wall, an outside bottom, and two side panels. Each of the side walls are joined, in turn, i.e., the first side wall is joined with the third side wall which is joined with the second wall which is joined with the fourth side wall. A flap is joined to the distal side of the fourth side wall. When the body is glued but not folded, the flap is glued to outside of the first side wall.

In one embodiment, the third side wall is further joined with an outside bottom to which the first side panel and the second side panel are attached at opposite sides of the inside bottom. An inside bottom is attached to a side of the fourth side wall normal to the flap and the second side wall.

In another embodiment, the third side wall is further joined with an inside bottom to which the first side panel and the second side panel are attached at opposite sides of the inside bottom. An outside bottom is attached to a side of the fourth side wall normal to the flap and the second side wall. In this embodiment, at least one horizontal retaining slot is provided where the third side wall is joined with the inside bottom. The outside bottom has at least one tab provided on the distal side of the outside bottom so that when the box is folded, the tab is inserted into the horizontal retaining slot.

Although the file holder of the present invention can be constructed of any suitable material, it is particularly advantageous if it is constructed of corrugated fiberboard because it is stable and sturdy yet it can be easily folded.

DETAILED DESCRIPTION OF THE INVENTION AND PREFERRED EMBODIMENTS

Figure 1:
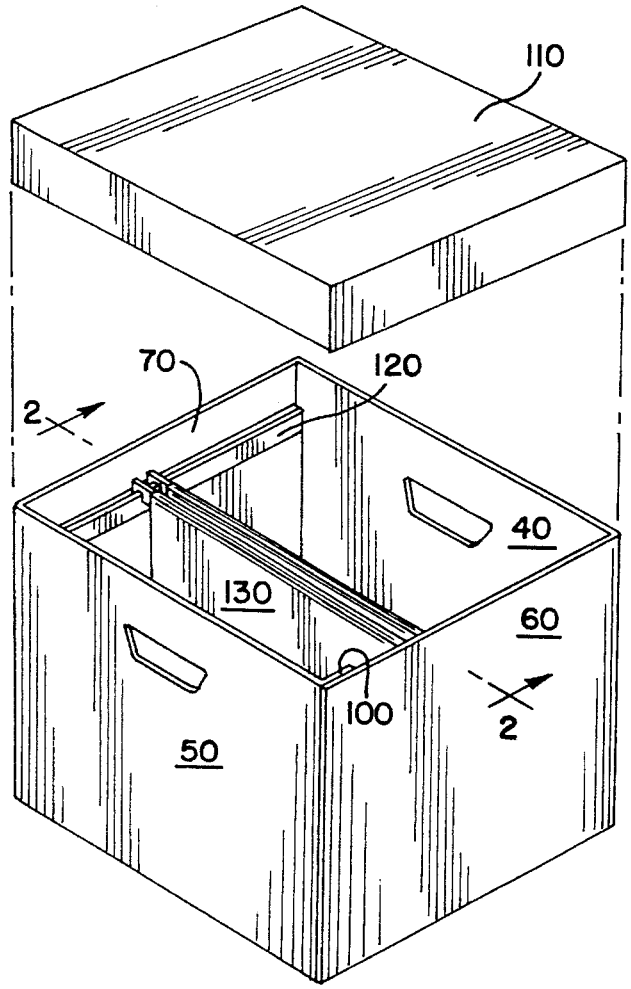
FIG. 1 shows a perspective view of one embodiment of the hanging folder file box of the present invention with the lid removed and with hanging folders in place upon the channels.

FIG. 1 shows the assembled hanging folder file box of the present invention with the lid removed and the hanging file folders installed onto the channels. The file box of the present invention includes a body 10 having a base including an inside bottom panel 20, 220 and an outside bottom panel 30, 230, a first pair of spaced apart and parallel side walls 40, 50, a second pair of spaced apart and parallel side walls 60, 70 normal to the first pair of spaced apart side walls, and a pair of bottom side panels 80, 90 adjacent two of the side walls and having a vertical height less than the vertical height of the side walls 40, 50, 60, 70. A pair of channels 120 are removably engaged to the side panels 80, 90 to removably receive the notched ends 132 of the rod 131 on a hanging folder 130. A lid or cover 110 may be provided to closely surround the side walls and contain the contents of the box.

The sides of the box may have any desirable length or width suitable for receiving hanging folders. These hanging folders generally have a pair of hanging rods 131 that support, typically, a flexible fiberboard folder. The rods have notched ends 132 that rest on metal rods and the like typically provided in desk drawers or file cabinets. Generally, the hanging folders have a file indicia that extends upward from the folder to provide an area where the contents of the folder can be described. Since there has evolved two commonly used sizes of hanging folders, letter and legal size, the sides of the box 40 and 50 are sized to accommodate the width of either letter size hanging folders or legal size hanging folders. It is to be understood, however, that the sides may have any desirable length.

It will also be seen from FIG. 1, that slots 41, 51 are provided on sides 40 and 50. The slots function as carrying handles for the box. The slots may be of any desirable shape including rectangular, curved, and the like. The slots may be entirely cut-out on four sides or may only be cut-out on three sides to provide a flap that may be folded into the box. Generally, only two opposite sides of the box will have slots while the other two opposite sides will be adjacent to the bottom side panels which have the channels to receive the notched ends of the hanging folders. Preferably, the sides of the box that-have slots are normal to the sides of the box adjacent the bottom side panels. In this way, when someone wishes to pick up the box, they can insert their fingers into the slots and slightly move the hanging folders toward the middle of the box to provide room for their hands so they can obtain a firm grip on the slot. In contrast, if the slots were provided on the sides of the box adjacent the bottom side panels, the space provided within the box is limited by the width of the hanging folders and can not be enlarged. Thus, it would be difficult to obtain a firm grip on the box.

An important aspect of the box of the present invention is that the vertical height of the sides 40, 50, 60, 70, as measured from their bottom to their top, is approximately equal, and preferably is equal. In addition, the vertical height of the bottom side panels 80, 90, as measured from their bottom to their top, is approximately equal, preferably equal, and is less than the vertical height of the sides. In the most preferred embodiment, the vertical height of the bottom side panels are about two inches less than the vertical height of the side walls. In this way the entire contents of the hanging folders, including the hanging folders and their file indicia can be contained below the top of the sides and, thus within the box.

Moreover, since the vertical height of the sides is greater than the vertical height of the bottom side panels, a lid that completely surrounds and snugly fits the box can be provided. It will also be understood that by providing sides of approximately equal vertical height, several like boxes can be vertically stacked in a stable fashion. If the vertical height of the sides were not approximately equal, the upper vertically adjacent box would be supported, for example, by only two of the sides of the box, resulting in less stable vertical stack as compared to the present invention.

Figure 3:
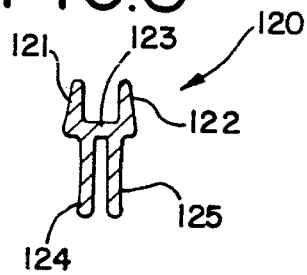
FIG. 3 shows an end view of the channel of the present invention.
Figure 2:
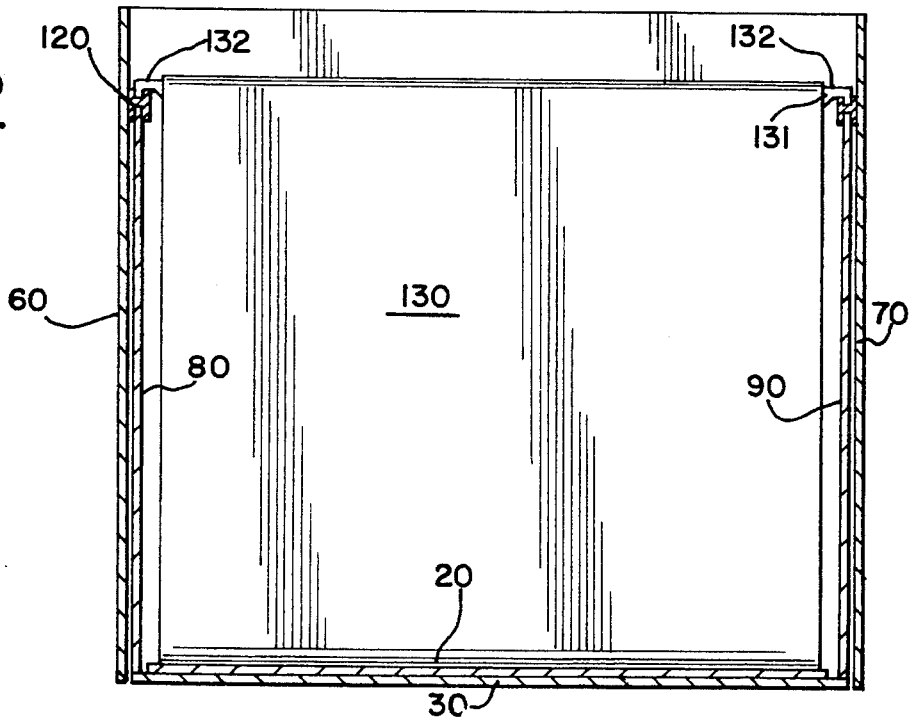
FIG. 2 shows a cross sectional view of the file box of FIG. 1 along line 2—2.

Turning now to FIG. 2, a cross sectional view of one embodiment of the box of the present invention is shown. It will be seen that the channels 120, better seen in FIG. 3, are removably received on the top edge of the bottom side panels. The channels are H-shaped with a pair of downstanding flanges that receive the top edge of the bottom side panels and a pair of upstanding flanges that receive the notched ends 132 of the hanging folders. In particular, the channels 120 have a pair of upstanding flanges 121, 122 that are joined with a pair of downstanding flanges 124, 125 through a cross member 123. The channels therefore have an H-shape. The downstanding flanges 124, 125 are spaced apart a distance slightly greater than the thickness of the top edge of the bottom side panels so that the channels can be removably engaged on the top edge of the bottom side panels. The upstanding flanges 121, 123 are spaced apart a distance sufficient to receive the notched ends of the hanging folders and to permit the notched ends and thus the hanging folders to slidably move along the channels. In this way, when a number of hanging folders are provided on the channels, a particular folder and its contents can be easily located and accessed. Preferably, the distance between the upstanding flanges 121, 123 is greater than the distance between the downstanding flanges 124, 125 so that, for example, the consumer can readily tell which end should be placed onto the bottom side panels.

Figure 4:
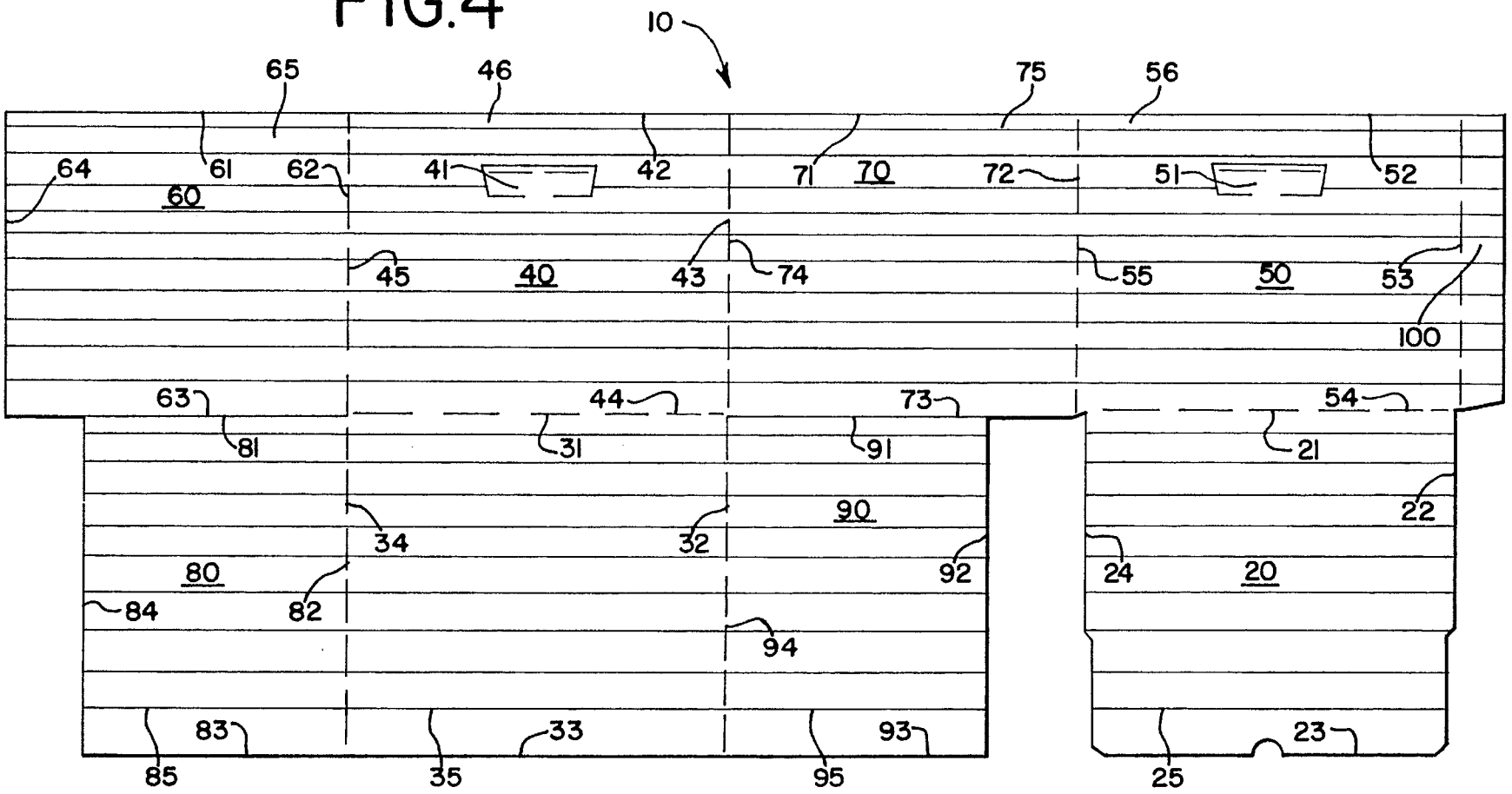
FIG. 4 shows a top view of one embodiment of the body of the hanging folder file box of the present invention in an unglued and unfolded state.

Turning now to FIG. 4, one embodiment of the body of the box is shown in an unglued and unfolded state. The body of the box includes a first pair of side walls, including a first side wall 40 and a second side wall 50 and a second pair of side walls, including a third side wall 60 and a fourth side wall 70. The third side wall 60 has four sides or edges 61, 62, 63, 64 such that when the body is assembled, edge 61 is the top edge, edge 63 is the bottom edge, and edges 62, 64 are vertical comer edges. The side edge 62 of the fourth side is coextensive with an edge 45 of the first side wall 40. In this regard, the first side wall 40 has four sides or edges 42, 43, 44, 45 such that when the body is assembled, edge 42 is the top edge, edge 44 is the bottom edge, and edges 43, 45 are vertical comer edges. A slot 41 is provided near but spaced from edge 42. Edge 43 is coextensive with an edge 74 of the fourth side wall 70.

Side wall 70 likewise has four sides or edges 71, 72, 73, 74 such that when the body is assembled, edge 71 is the top edge, edge 73 is the bottom edge, and edges 72, 74 are vertical comer edges. The edge 72 is coextensive with the edge 55 of the second side wall 50. The second side wall 50 has four sides or edges 52, 53, 54, 55 such that when the body is assembled, edge 52 is the top edge, edge 54 is the bottom edge, and edges 53, 55 are vertical comer edges. A slot 51 is provided near but spaced from edge 52.

The flap 100 is coextensive with the edge 53 of the fourth side wall. When the body is assembled, as shown in FIG. 1, the flap 100 is preferably located within the box, although if desired it may be located on the outer perimeter of the box. The flap 100 is secured to the third side wall 60 adjacent edge 64. The flap may be secured by any well known means, preferably glued.

In this embodiment, the base includes an inside bottom panel 20 and an outside bottom panel 30. The inside bottom panel has four edges 21, 22, 23, and 24, with edge 21 coextensive with the edge 54 of the second side wall 50. When the body is assembled, edge 22 will be adjacent edge 63, edge 23 will be adjacent edge 44, and edge 24 will be adjacent edge 73. An outside bottom panel 30 is also provided. The outside bottom panel has four edges 31, 32, 33, 34 with the edge 31 coextensive with the edge 44 of the first side wall 40. In addition, the edge 34 of the outside bottom panel is coextensive with an edge 82 of the first bottom side panel 80. The first bottom side panel has four edges 81, 82, 83, 84 with edge 81 adjacent edge 63 of the third side wall. When the body is assembled, edge 84 is the top edge of the first bottom side panel 80 and receives the channel 120.

The edge 32 of the outside bottom panel is coextensive with an edge 94 of the second bottom side panel 90. The second bottom side panel has four edges 91, 92, 93, 94 with edge 91 adjacent to the edge 73 of the fourth side wall 70. When the body is assembled, edge 92 is the top edge of the second bottom side panel 90 and receives the channel 120.

Figure 5:
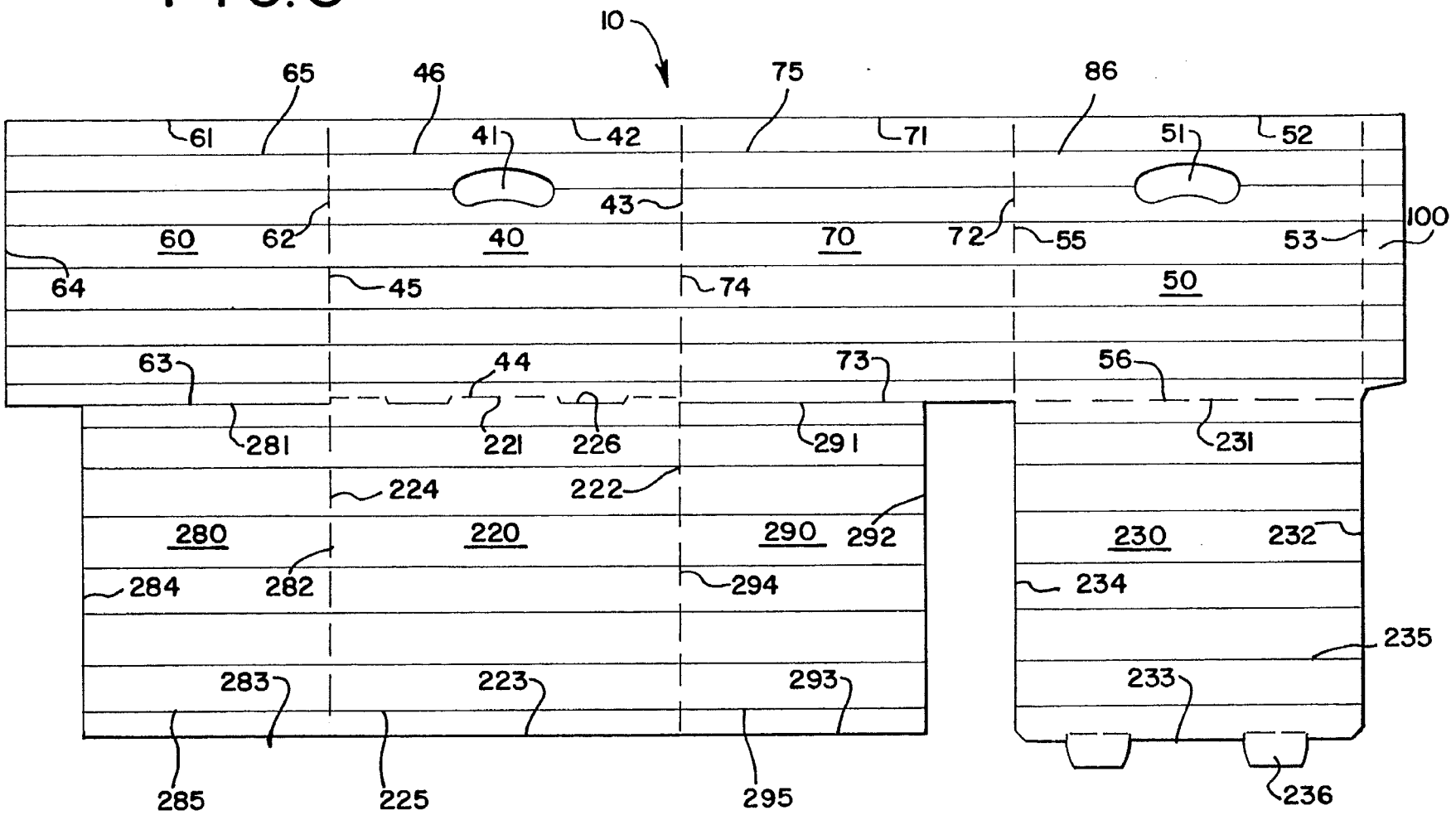
FIG. 5 shows a top view of another embodiment of the body of the hanging folder file box of the present invention in an unglued and unfolded state.

In another embodiment of the present invention, shown in FIG. 5, the side walls 40, 50, 60, 70 and the flap 100 are identical to the above-described embodiment, and thus are referred to with identical reference numerals. In this embodiment, however, the base includes an inside bottom panel 220 and an outside bottom panel 230. The inside bottom panel 220 has four edges 221, 222, 223, and 224 with edge 221 coextensive with the edge 44 of the first side wall 40. In addition, at least one cut-out or slot 226 is provided along the edges 44, 221 to receive a tab on the outside bottom panel, as will be described in more detail below. Preferably, two slots are provided.

The edge 224 of the inside bottom panel is coextensive with an edge 282 of the first bottom side panel 280. The first bottom side panel has four edges 281,282, 283, 284 with edge 281 adjacent to edge 63 of the third side wall. When the body is assembled, edge 284 is the top edge of the first bottom side panel 280 and receives the channel 120.

The edge 222 of the inside bottom panel 220 is coextensive with an edge 294 of the second bottom side panel 290. The second bottom side panel has four edges 291, 292, 293, 294 with edge 291 adjacent to the edge 73 of the fourth side wall 70. When the body is assembled, edge 292 is the top edge of the second bottom side panel 290 and receives the channel 120.

The outside bottom panel has four edges 231, 232, 233, 234 with edge 231 coextensive with edge 56 of the second side wall 50. At least one tab 236 is coextensive with and extends from the edge 233 of the outside bottom panel 230 to engage the slot 226, as will be more fully described below. Preferably, two tabs are provided to respectively engage the two slots.

Figure 6:
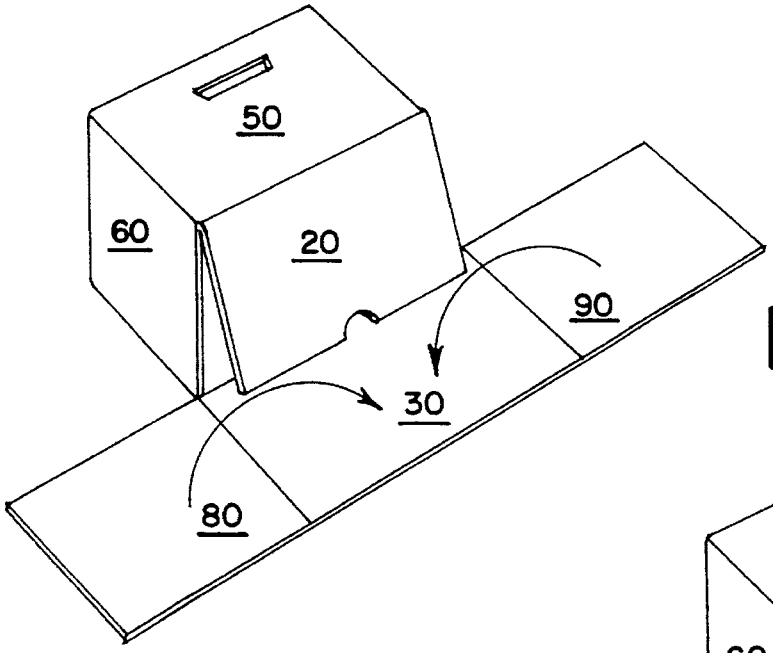
FIGS. 6–9 show the assembly of the body of the hanging folder file box of FIG. 4.

In the most preferred embodiment, the body of the box is constructed of corrugated fiberboard so that the body may be folded to complete the assembly. Assembly of the embodiment shown in FIG. 4 will now be described. The edges 53, 55, 72, 74, 43, 45, and 62 are folded so that the flap contacts the third side wall 60 adjacent the edge 64 of the third side wall 60. The flap 100 is then secured to the third side wall, preferably on the inside portion of the third side wall by, for example, glue. The body is then opened and squared into shape so that the first pair of side walls 40, 50 are substantially parallel and normal to the second pair of side walls 60, 70. The inside bottom panel 20 is folded along the edge 21 into the open body, as best seen in FIG. 6.

Figure 7:
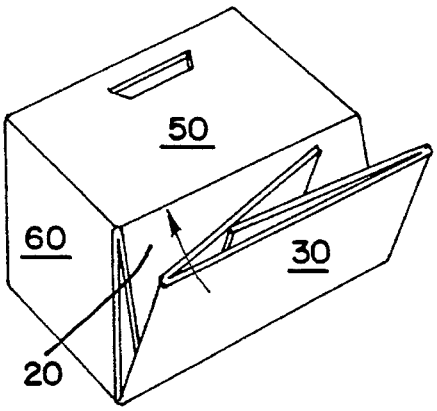
Figure 8:
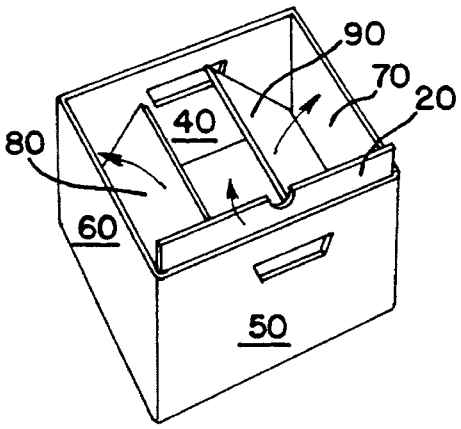
Figure 9:
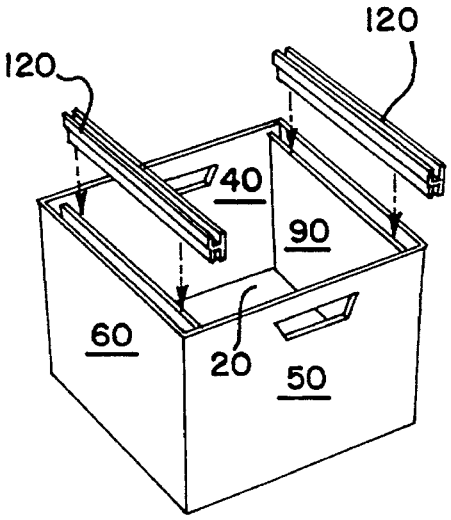

The first bottom side panel 80 and the second bottom side panel 90 are folded onto the outside bottom 30 so that the first bottom side panel 80 is vertically adjacent, i.e., on top of the bottom 30 and the second bottom side panel 90 is vertically adjacent, i.e., on top of the first bottom side panel 80, or vice versa, as shown in FIG. 7. The bottom 30 is then folded along edge 31 into the open body so that the bottom side panels 80 and 90 extend into the body. The side panels 80 and 90 are then raised to a vertical position adjacent side walls 60 and 70, respectively, as shown in FIG. 80 The inside bottom 20 is folded down on top of outside bottom 30 to complete the assembly of the body of the box. As noted above, the channels are removably engaged with the top edges 84, 92 of the bottom side panels 80, 90 to receive the hanging folders, as shown in FIG. 9.

Assembly of the embodiment of FIG. 5 will now be described. The edges 53, 55, 72, 74, 43, 45, and 62 are folded so that the flap contacts the third side wall 60 adjacent the edge 64 of the third side wall 60. The flap 100 is then secured to the third side wall, preferably on the inside portion of the third side wall by, for example, glue. The body is then opened and squared into shape so that the first pair of side walls 40, 50 are substantially parallel and normal to the second pair of side walls 60, 70, as shown in FIG. 10.

Figure 10:
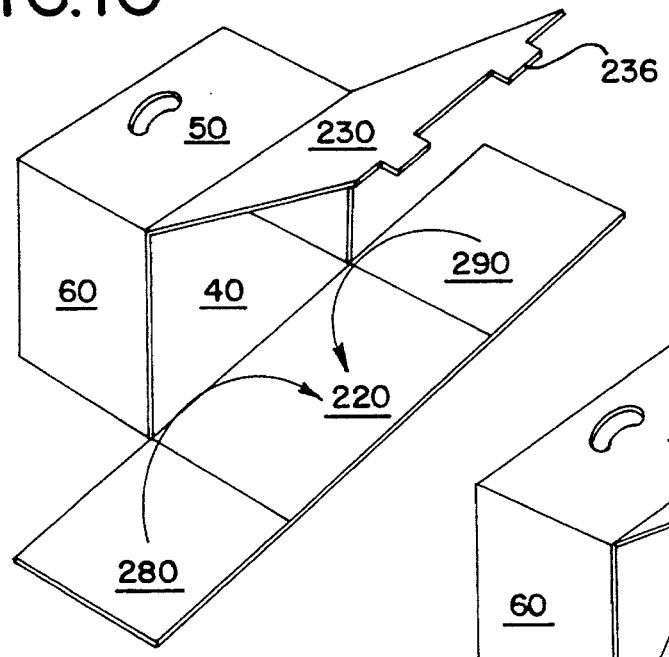
FIGS. 10–14 show the assembly of the body of the hanging folder file box of FIG. 5.
Figure 11:
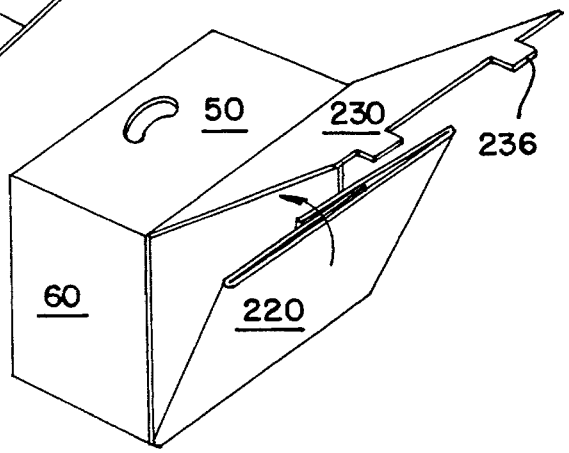
Figure 12:
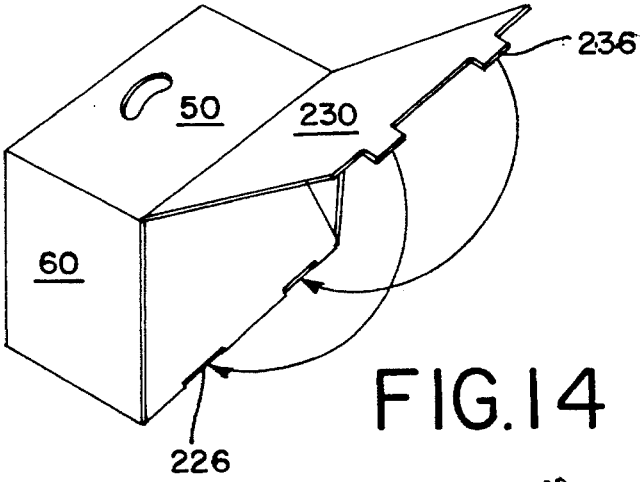
Figure 13:
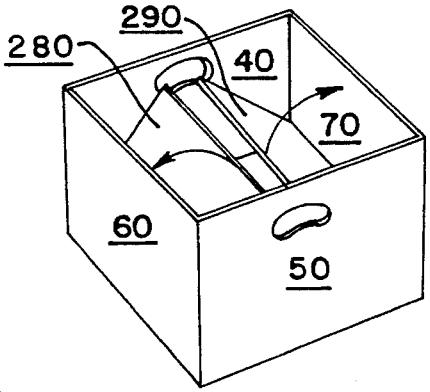
Figure 14:
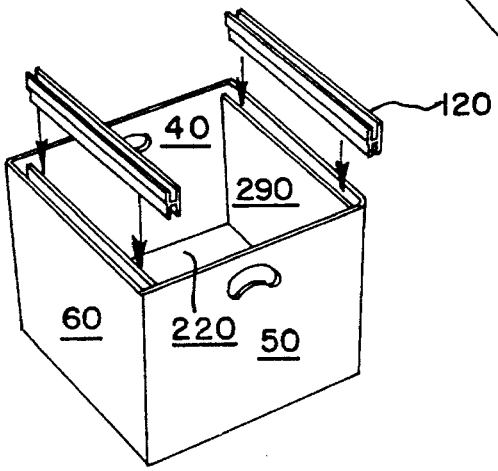

The first bottom side panel 280 and the second bottom side panel 290 are folded onto the inside bottom 220 so that the first bottom side panel 280 is vertically adjacent, i.e., on top of the bottom 220 and the second bottom side panel 290 is vertically adjacent, i.e., on top of the first bottom side panel 280, or vice versa, as shown in FIG. 10. The bottom 220 is then folded along edge 221 into the open body so that the bottom side panels 280 and 290 extend into the body, as shown in FIG. 11. The outside bottom panel 230 is then folded along the edge 231 and the tabs 236 are inserted into the slots 226 to complete the body, as shown in FIG. 12. The side panels 280 and 290 are then raised to a vertical position adjacent side walls 60 and 70, respectively, as shown in FIG. 13. As noted above, the channels are removably engaged with the top edges 84, 92 of the bottom side panels 80, 90 to receive the hanging folders, as shown in FIG. 14.

Since in the most preferred embodiment, the body of the box is constructed from corrugated fiberboard, flutes are present. It will be understood by one skilled in the art that the direction of the flutes indicates the dimension of greatest strength. In the body of the most preferred embodiment of the present invention, when the body is assembled the flutes in each of the side walls 46, 56, 65, 75 are oriented in a horizontal direction. Likewise, the flutes in the each of the bottom side panels of both embodiments of the present invention are parallel to the flutes in the side walls when the body is assembled. The flutes in the bottom side panels 85, 95, 285, 295, however, are oriented in a direction normal to the flutes in the side walls, i.e., in the vertical direction when the body of the box is assembled. By providing the flutes in the vertical direction, the bottom side panels advantageously have sufficient strength to support the weight of the contents of the hanging file folders. It will be appreciated that if the flutes were oriented in the horizontal direction, the weight of the contents of the hanging folders may cause the bottom side panels to bend and become distorted.

While the most preferred embodiment of the file box comprises a unitary body, it is within the scope of the present invention to provide one or more separate parts. For example, one or more of the bottoms, side walls, side panels and flap can be separate pieces. The pieces could then be joined by glue, tape, staples, and other well known means for joining.

Of course it should be understood that a wide range of changes and modifications can be made to the embodiments described above. It is therefore intended that the foregoing description illustrates rather than limits this invention, and that it is the following claims, including all equivalents, which define this invention.

What is claimed:

1. A hanging folder box comprising:

a. a base, a first pair of spaced apart and parallel side walls and a second pair of spaced apart and parallel side walls normal to the first pair of side walls, each of the side walls extending upward from the bottom substantially the same vertical height;

b. a pair of spaced apart and parallel side panels adjacent the first pair side walls and extending upward from the bottom a vertical height less than the vertical height of the side walls; and, c. a first and a second channel each removably engaged with each side panel and having a pair of upward extending flanges.

2. The box of claim 1 wherein slots are provided in the second pair of side walls.

3. The box of claim 1 wherein each channel has a pair of downward extending flanges spaced apart a distance slightly greater than the thickness of the side panels to slidably engage the side panel.

4. The box of claim 3 wherein the upward extending flanges are spaced apart a distance larger than the distance the downward extending flanges are spaced apart.

5. The box of claim 1 wherein the base further includes an inside bottom panel and an outside bottom panel, the inside and outside bottom panels being vertically adjacent each other.

6. The box of claim 5 wherein the side panels are joined with the inside bottom panel.

7. The box of claim 5 wherein the side panels are joined with the outside bottom panel.

* * * * *